US009435218B2

(12) United States Patent
Casavant et al.

(10) Patent No.: US 9,435,218 B2
(45) **Date of Patent: *Sep. 6, 2016**

(54) SYSTEMS RELATING TO AXIAL POSITIONING TURBINE CASINGS AND BLADE TIP CLEARANCE IN GAS TURBINE ENGINES

(71) Applicant: General Electric Company, Schenectady, NY (US)

(72) Inventors: Matthew Stephen Casavant, Greenville, SC (US); Kenneth Damon Black, Travelers Rest, SC (US); Christopher Paul Cox, Greenville, SC (US)

(73) Assignee: General Electric Company, Schenectady, NY (US)

( * ) Notice: Subject to any disclaimer, the term of this patent is extended or adjusted under 35 U.S.C. 154(b) by 461 days.

This patent is subject to a terminal disclaimer.

(21) Appl. No.: 13/955,647

(22) Filed: Jul. 31, 2013

(65) Prior Publication Data

US 2015/0037145 A1 Feb. 5, 2015

(51) Int. Cl.

| | |
|---|---|
| ***F01D 11/16*** | (2006.01) |
| ***F01D 11/14*** | (2006.01) |
| ***F01D 11/18*** | (2006.01) |
| ***F01D 11/20*** | (2006.01) |
| ***F01D 11/22*** | (2006.01) |
| ***F01D 11/24*** | (2006.01) |

(52) U.S. Cl.

CPC ..... *F01D 11/16* (2013.01); *F01D 11/14* (2013.01); *F01D 11/18* (2013.01); *F01D 11/20* (2013.01); *F01D 11/22* (2013.01); *F01D 11/24* (2013.01); *F05D 2240/14* (2013.01)

(58) Field of Classification Search

CPC ..... F01D 11/08; F01D 11/14; F01D 11/16; F01D 11/18; F01D 11/20; F01D 11/22; F01D 11/24; F05D 2240/10; F05D 2240/14

See application file for complete search history.

(56) References Cited

U.S. PATENT DOCUMENTS

| | | | | |
|---|---|---|---|---|
| 4,242,247 | A | 12/1980 | Pellon et al. | |
| 4,332,523 | A | 6/1982 | Smith | |
| 5,203,673 | A * | 4/1993 | Evans | F01D 11/22 415/10 |
| 6,672,831 | B2 | 1/2004 | Brandl et al. | |
| 7,686,569 | B2 | 3/2010 | Paprotna et al. | |

(Continued)

FOREIGN PATENT DOCUMENTS

| | | |
|---|---|---|
| EP | 1706597 B1 | 3/2009 |

*Primary Examiner* — Igor Kershteyn
*Assistant Examiner* — Christopher R Legendre
(74) *Attorney, Agent, or Firm* — Mark E. Henderson; Ernest G. Cusick; Frank A. Landgraff

(57) ABSTRACT

A gas turbine engine that includes: a flowpath defined through one of a compressor and a turbine; an inner casing defining an axially tilted outboard boundary of the flowpath, which, relative to the axial tilt, defines a converging direction in which the flowpath converges and a diverging direction in which the flowpath diverges; a row of rotor blades having outer tips that oppose the outboard boundary across a gap clearance defined therebetween; an outer casing concentrically arranged about the inner casing so to form an annulus therebetween; and a connection assembly that slidably connects the inner casing to the outer casing and includes a biasing means for axially preloading the inner casing in the converging direction.

19 Claims, 7 Drawing Sheets

(56) References Cited

U.S. PATENT DOCUMENTS 8,864,443 B2 * 10/2014 Narita ..... F01D 11/06 415/113
2002/0150469 A1 * 10/2002 Bolms ..... F01D 11/22 415/115
2008/0063513 A1 * 3/2008 Afanasiev ..... F01D 11/22 415/138
2015/0037133 A1 * 2/2015 Casavant ..... F01D 11/18 415/1
2015/0037145 A1 * 2/2015 Casavant ..... F01D 11/16 415/173.3

* cited by examiner

SYSTEMS RELATING TO AXIAL POSITIONING TURBINE CASINGS AND BLADE TIP CLEARANCE IN GAS TURBINE ENGINES

BACKGROUND OF THE INVENTION

The present invention relates generally to gas turbine engines and, more particularly, to an apparatus for passively controlling the axial position of an inner casing within the compressor or turbine section of a gas turbine engine based on flowpath pressures during different modes of engine operation as well as using this method of control to advantageously adjusting a gap clearance between adjacent rotating and non-rotating components.

As one of ordinary skill in the art will appreciate, the efficiency of a gas turbine engine is dependent upon many factors, one of which is the radial clearance between adjacent rotating and non-rotating components, such as, for example, the rotor blade tips and the casing shroud surrounding the outer tips of the rotor blades. If the clearance is too great, an unacceptable degree of working fluid leakage will occur with a resultant loss in efficiency. If the clearance is too little, there is a risk that under certain conditions contact will occur between the components and cause damage thereto.

The potential for contact between rotating and non-rotating components may be present over a range of engine operating conditions. For example, one such condition is when the engine rotational speed is changing, either increasing or decreasing, since temperature differentials across the engine frequently result in the rotating and non-rotating components radially expanding and contracting at different rates. For instance, upon engine accelerations, thermal growth of the rotor typically lags behind that of the casing. During steady-state operation, the growth of the casing ordinarily matches more closely that of the rotor. Upon engine decelerations, the casing contracts more rapidly than the rotor. These type of issues are also present during both startup and shutdown procedures, as it is often difficult to match the casing to rotor thermal growths during these operations.

Control mechanisms, usually mechanically or thermally actuated, have been proposed in the prior art to maintain or reduce blade tip clearance so that leakage is minimized. However, none represent an optimized or efficient design. Specifically, active control systems require feedback loops, control systems, extra components and, thereby, add cost to the machine. It will be appreciated that, if passive systems could provide similar results, they would be desirable due to their more simplified activation strategy, which typically requires fewer parts, less cost, and greater robustness. Consequently, a need still remains for an improved mechanism for clearance control that maintains a narrow tip-shroud clearance through the operational range of the engine so to improve engine performance and reduce fuel consumption. Additionally, it will be appreciated that conventional methods and systems for axially positioning the inner casings typically are present through the compressor and turbine sections of the engine are similarly deficient, and that there would be commercial demand for improved methods and systems for controlling the axial position of these structures. As will be appreciated, such methods of control, if made cost-effective, robust and efficient, may be put to other uses than the specific exemplary ones described herein.

BRIEF DESCRIPTION OF THE INVENTION

The present application thus describes a gas turbine engine that includes: a flowpath defined through one of a compressor and a turbine; an inner casing defining an axially tilted outboard boundary of the flowpath, which, relative to the axial tilt, defines a converging direction in which the flowpath converges and a diverging direction in which the flowpath diverges; a row of rotor blades having outer tips that oppose the outboard boundary across a gap clearance defined therebetween; an outer casing concentrically arranged about the inner casing so to form an annulus therebetween; and a connection assembly that slidably connects the inner casing to the outer casing for axial movement and includes a biasing means for axially preloading the inner casing in the converging direction.

The invention further describes a gas turbine engine that includes: a compressor through which a flowpath is defined, the flowpath having a downstream and a upstream direction relative to a flow of working fluid therethrough; an inner casing defining an outboard boundary of the flowpath having an axially tilted profile so that, along the outboard boundary, the flowpath has a conical taper in the downstream direction; a row of circumferentially spaced rotor blades positioned in the flowpath, the rotor blades having outer tips that oppose the outboard boundary across a gap clearance defined therebetween; an outer casing concentrically arranged about the inner casing so to form an annulus therebetween; and a connection assembly that slidably connects the inner casing to the outer casing for axial movement between a downstream position and an upstream position. The connection assembly may include a compression spring that axially preloads the inner casing toward the downstream position. The inner casing may include a receiving surface that defines a boundary of the annulus, the receiving surface configured to axially load the inner casing toward the upstream position so to oppose the axial preload of the compression spring.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
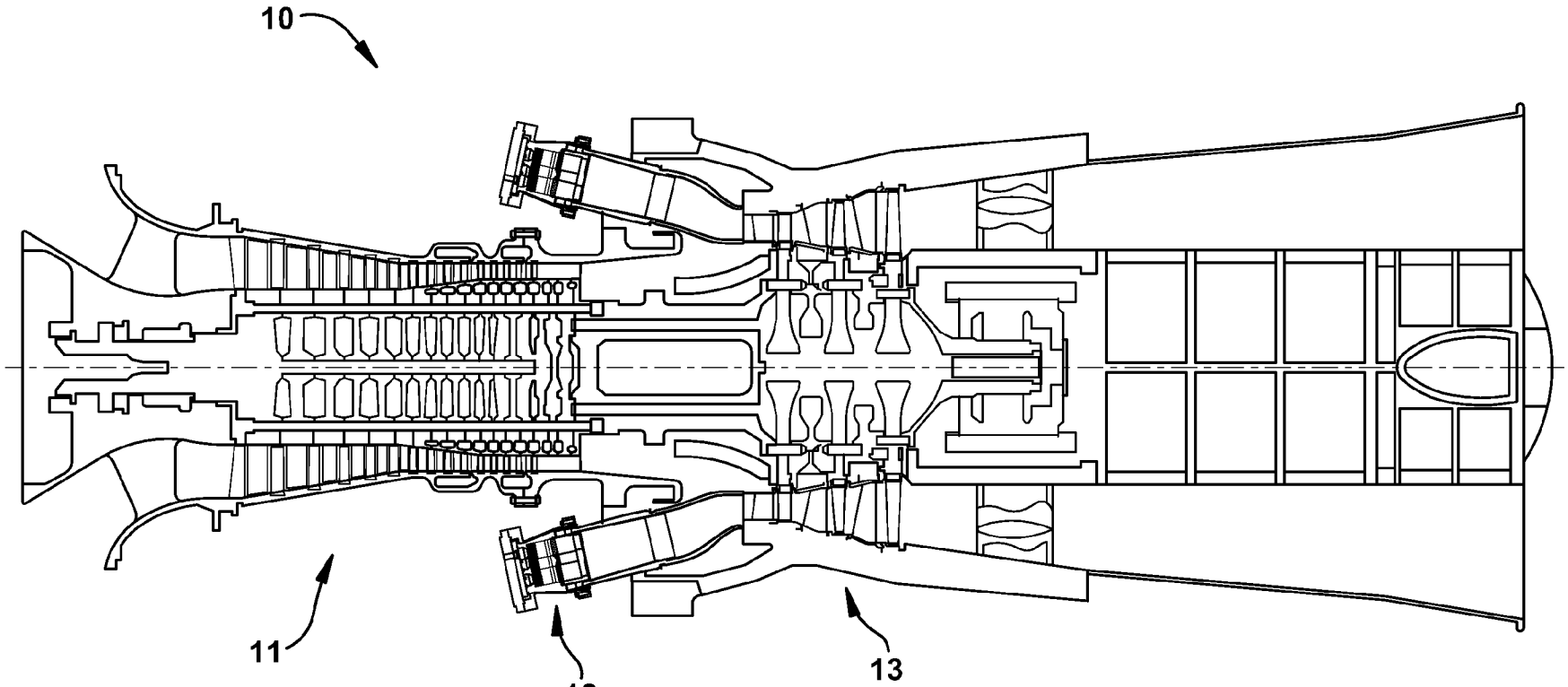
Figure 1 (Prior Art)
FIG. 1 is a sectional schematic representation of an exemplary gas turbine in which certain embodiments of the present application may be used.

The following description provides examples of both conventional technology and the present invention, as well as, in the case of the present invention, several exemplary implementations and explanatory embodiments. It will be appreciated that the following examples are not intended to be exhaustive as to all possible applications of the invention. While the following examples may be presented in relation to a certain type of turbine engine, the technology of the present invention may be applicable to other types of turbine engines, as would the understood by a person of ordinary skill in the relevant technological arts.

Certain terminology has been selected to describe the present invention in the text that follows. To the extent possible, these terms have been chosen based on the terminology common to the technology field. Still, it will be appreciate that such terms often are subject to differing interpretations. For example, what may be referred to herein as a single component, may be referenced elsewhere as consisting of multiple components, or, what may be referenced herein as including multiple components, may be referred to elsewhere as being a single component. In understanding the scope of the present invention, attention should not only be paid to the particular terminology used, but also to the accompanying description and context, as well as the structure, configuration, function, and/or usage of the component being referenced and described, including the manner in which the term relates to the several figures, as well as, of course, the precise usage of the terminology in the appended claims.

Because several descriptive terms are regularly used in describing the components and systems within turbine engines, it should prove beneficial to define these terms at the onset of this section. Accordingly, these terms and their definitions, unless specifically stated otherwise, are as follows. The terms "forward" and "aft", without further specificity, refer to directions relative to the orientation of the gas turbine. That is, "forward" refers to the forward or compressor end of the engine, and "aft" refers to the aft or turbine end of the engine. It will be appreciated that each of these terms may be used to indicate movement or relative position within the engine. The terms "downstream" and "upstream" are used to indicate position within a specified conduit relative to the general direction of flow moving through it. The term "downstream" refers to the direction in which the fluid is flowing through the specified conduit, while "upstream" refers to the direction opposite that.

Thus, for example, the primary flow of fluid through a turbine engine, which consists of air through the compressor and then becomes the combustion gases within the combustor, may be described as beginning from an upstream location at an upstream end of the compressor and terminating at an downstream location at a downstream end of the turbine. In regard to describing the direction of flow within a common type of combustor, as discussed in more detail below, it will be appreciated that compressor discharge air typically enters the combustor through impingement ports that are concentrated toward the aft end of the combustor (relative to the combustors longitudinal axis and the aforementioned compressor/turbine positioning defining forward/aft distinctions). Once in the combustor, the compressed air is guided by a flow annulus formed about an interior chamber toward the forward end of the combustor, where the air flow enters the interior chamber and, reversing it direction of flow, travels toward the aft end of the combustor. Coolant flows through cooling passages may be treated in the same manner.

Given the configuration of compressor and turbine about a central common axis as well as the cylindrical configuration common to certain combustor types, terms describing position relative to an axis will be used. In this regard, it will be appreciated that the term "radial" refers to movement or position perpendicular to an axis. Related to this, it may be required to describe relative distance from the central axis. In this case, if a first component resides closer to the central axis than a second component, it will be described as being either "radially inward" or "inboard" of the second component. If, on the other hand, the first component resides further from the central axis than the second component, it will be described herein as being either "radially outward" or "outboard" of the second component. Additionally, it will be appreciated that the term "axial" refers to movement or position parallel to an axis. Finally, the term "circumferential" refers to movement or position around an axis. As mentioned, while these terms may be applied in relation to the common central axis that extends through the compressor and turbine sections of the engine, these terms also may be used in relation to other components or sub-systems of the engine. For example, in the case of a cylindrically shaped combustor, which is common to many machines, the axis which gives these terms relative meaning is the longitudinal central axis that extends through the center of the cross-sectional shape, which is initially cylindrical, but transitions to a more annular profile as it nears the turbine.

FIG. 1 is a partial cross-sectional view of a known gas turbine engine 10 in which embodiments of the present invention may be used. As shown, the gas turbine engine 10 generally includes a compressor 11, one or more combustors 12, and a turbine 13. It will be appreciated that a flowpath is defined through the gas turbine 10. During normal operation, air may enter the gas turbine 10 through an inlet section, and then fed to the compressor 11. The multiple, axially-stacked stages of rotating blades within the compressor 11 compress the air flow so that a supply of compressed air is produced. The compressed air then enters the combustor 12 and directed through a primary fuel injector, which brings together the compressed air with a fuel so to form an air-fuel mixture. The air-fuel mixture is combusted within a combustion chamber so that a high-energy flow of combustion products is created. This energetic flow of hot gases then is expanded through the turbine 13, which extracts energy from it.

Figure 2:
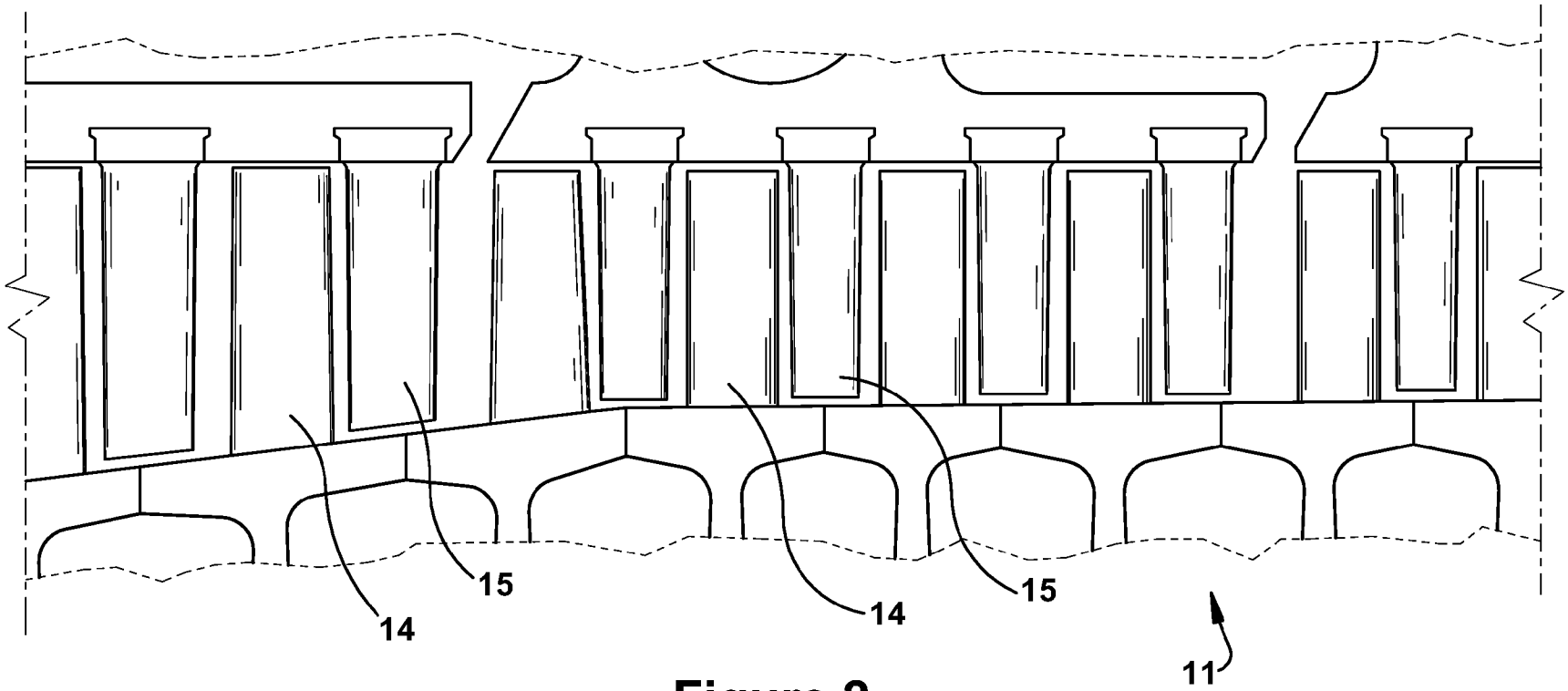
Figure 2 (Prior Art)
FIG. 2 is a sectional view of the compressor in the combustion turbine engine of FIG. 1.

FIG. 2 illustrates a view of an exemplary multi-staged axial compressor 11 that may be used in the combustion turbine engine of FIG. 1. As shown, the compressor 11 may include a plurality of stages. Each stage may include a row of compressor rotor blades 14 followed by a row of compressor stator blades 15. Thus, a first stage may include a row of compressor rotor blades 14, which rotate about a central shaft, followed by a row of compressor stator blades 15, which remain stationary during operation.

Figure 3:
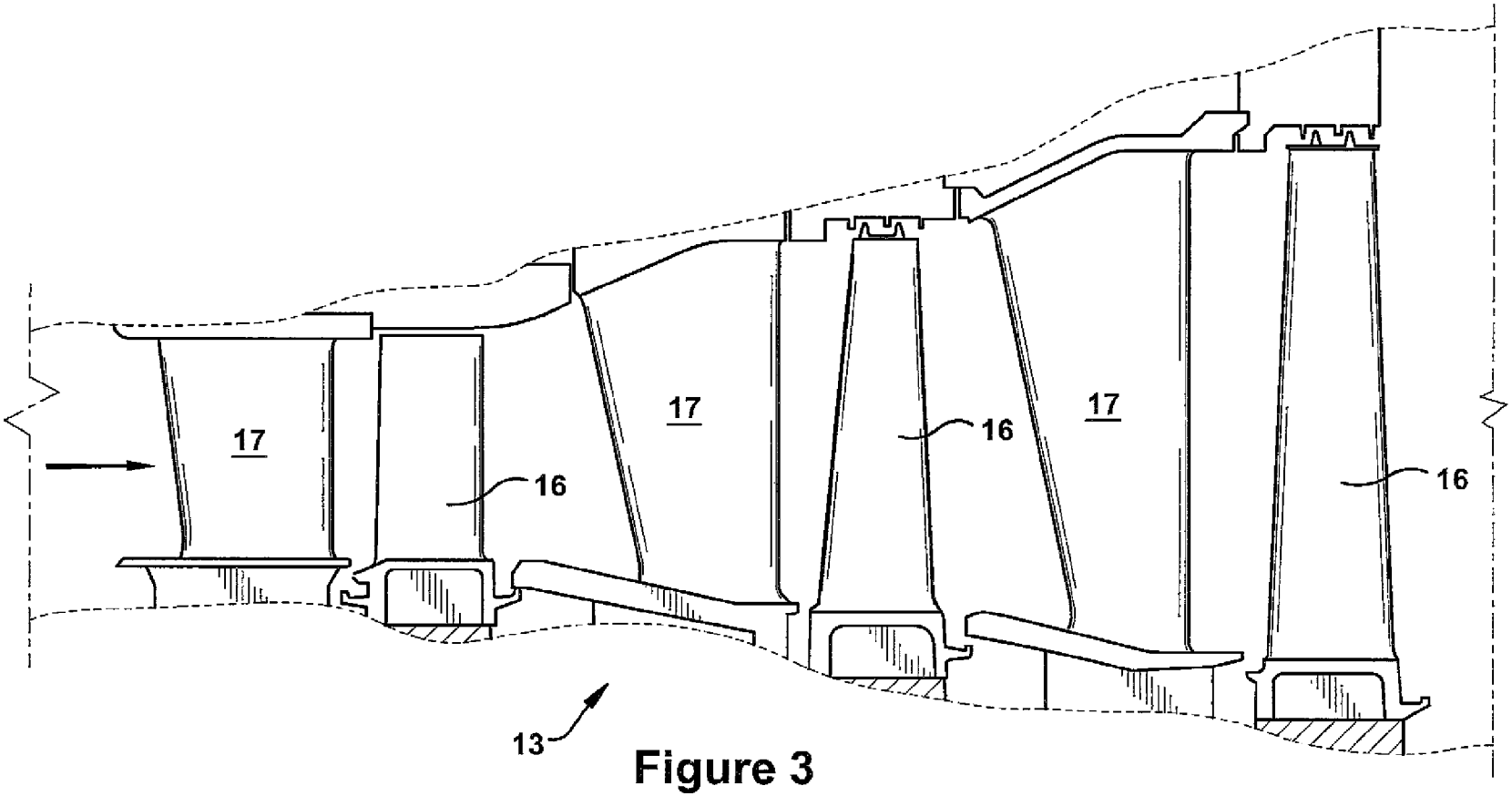
Figure 3 (Prior Art)
FIG. 3 is a sectional view of the turbine in the combustion turbine engine of FIG. 1.

FIG. 3 illustrates a partial view of an exemplary turbine section or turbine 13 that may be used in the combustion turbine engine of FIG. 1. The turbine 13 may include a plurality of stages. Three exemplary stages are illustrated, but more or less stages may be present in the turbine 13. A first stage includes a plurality of turbine buckets or turbine rotor blades 16, which rotate about the shaft during operation, and a plurality of nozzles or turbine stator blades 17, which remain stationary during operation. The turbine stator blades 17 generally are circumferentially spaced one from the other and fixed about the axis of rotation. The turbine rotor blades 16 may be mounted on a turbine wheel (not shown) for rotation about the shaft (not shown). A second stage of the turbine 13 also is illustrated. The second stage similarly includes a plurality of circumferentially spaced turbine stator blades 17 followed by a plurality of circumferentially spaced turbine rotor blades 16, which are also mounted on a turbine wheel for rotation. A third stage also is illustrated, and similarly includes a plurality of turbine stator blades 17 and rotor blades 16. It will be appreciated that the turbine stator blades 17 and turbine rotor blades 16 lie in the hot gas path of the turbine 13. The direction of flow of the hot gases through the hot gas path is indicated by the arrow.

In one example of operation, the rotation of compressor rotor blades 14 within the axial compressor 11 may compress a flow of air. In the combustor 12, energy may be released when the compressed air is mixed with a fuel and ignited. The resulting flow of hot gases from the combustor 12, which may be referred to as the working fluid, is then directed over the turbine rotor blades 16, the flow of working fluid inducing the rotation of the turbine rotor blades 16 about the shaft. Thereby, the energy of the flow of working fluid is transformed into the mechanical energy of the rotating blades and, because of the connection between the rotor blades 61 and the shaft, the rotating shaft. The mechanical energy of the shaft may then be used to drive the rotation of the compressor rotor blades 14, such that the necessary supply of compressed air is produced, and also, for example, a generator to produce electricity.

Figure 4:
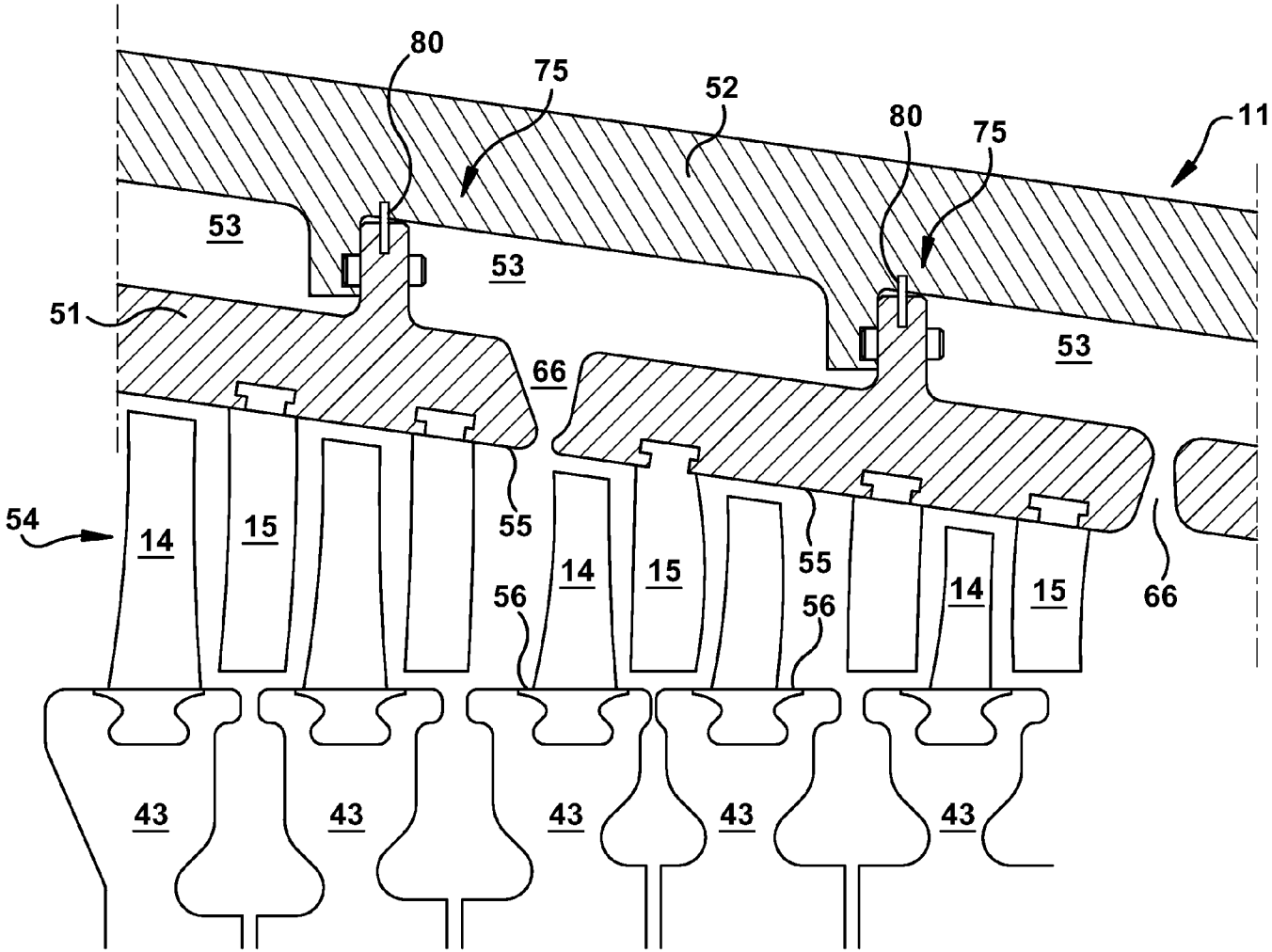
Figure 4 (Prior Art)
FIG. 4 is a schematic sectional representation of an exemplary flowpath assembly typical to gas turbine compressors pursuant to a conventional design.

FIG. 4 provides a schematic sectional representation of an exemplary flowpath 54 assembly of a compressor 11 in which embodiments of the present invention may be used. The compressor 11 defines an axially oriented flowpath 54 that includes alternating rows of rotor blades 14 and stator blades 15. The rotor blades 14 extend from a rotor disc 43, which, as shown, may include rotating structure that defines the inboard boundary of the flowpath 54. The stator blades 15 extend from a stationary inner casing 51 that defines an outboard boundary 55 of the flowpath 54. An outer casing 52 may be concentrically formed about the inner casing 51 such that an inter-casing annulus or annulus 53 is formed therebetween. As illustrated, the inner casing 51 may be connected to the outer casing 52 by an connection assembly 75 that includes radially overlapping flanges that are secured mechanically. As illustrated, the connection assembly 75 divides the annulus 53 into axially stacked compartments, which are fluidly sealed from each other by a seal 80. As illustrated, each of the compartments of the annulus 53 includes an extraction passage 66 connecting it to an extraction point formed on the flowpath 54. As the nature of the attachment assembly between the inner casing and the outer casing suggests, axial movement of the inner casing 51 relative to the outer casing 52 or to the flowpath 54 is not possible.

Figure 5:
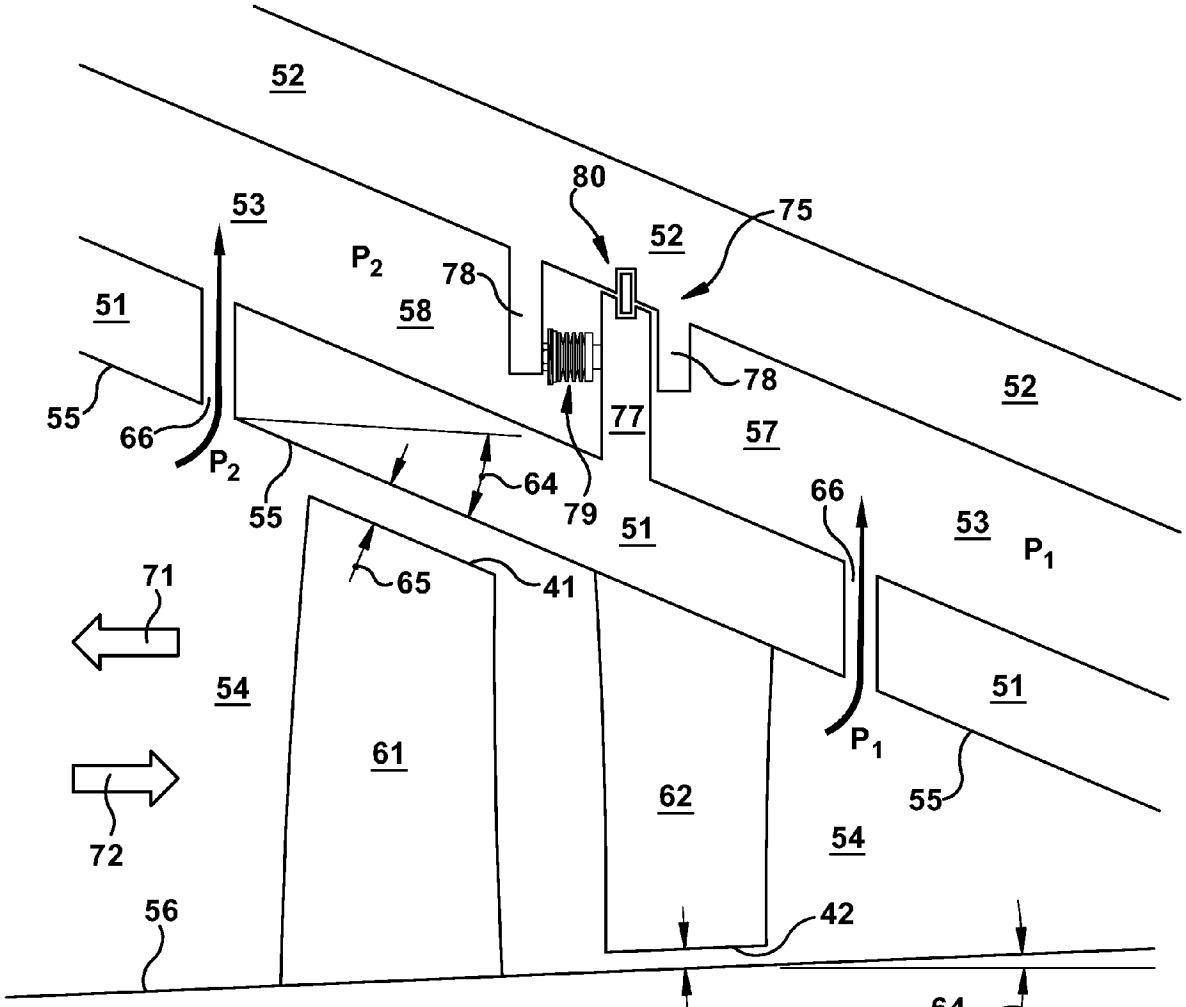
FIG. 5 is a simplified schematic sectional representation of a flowpath that might be found in a gas turbine engine, which illustrates certain aspects of the present invention.
Figure 6:
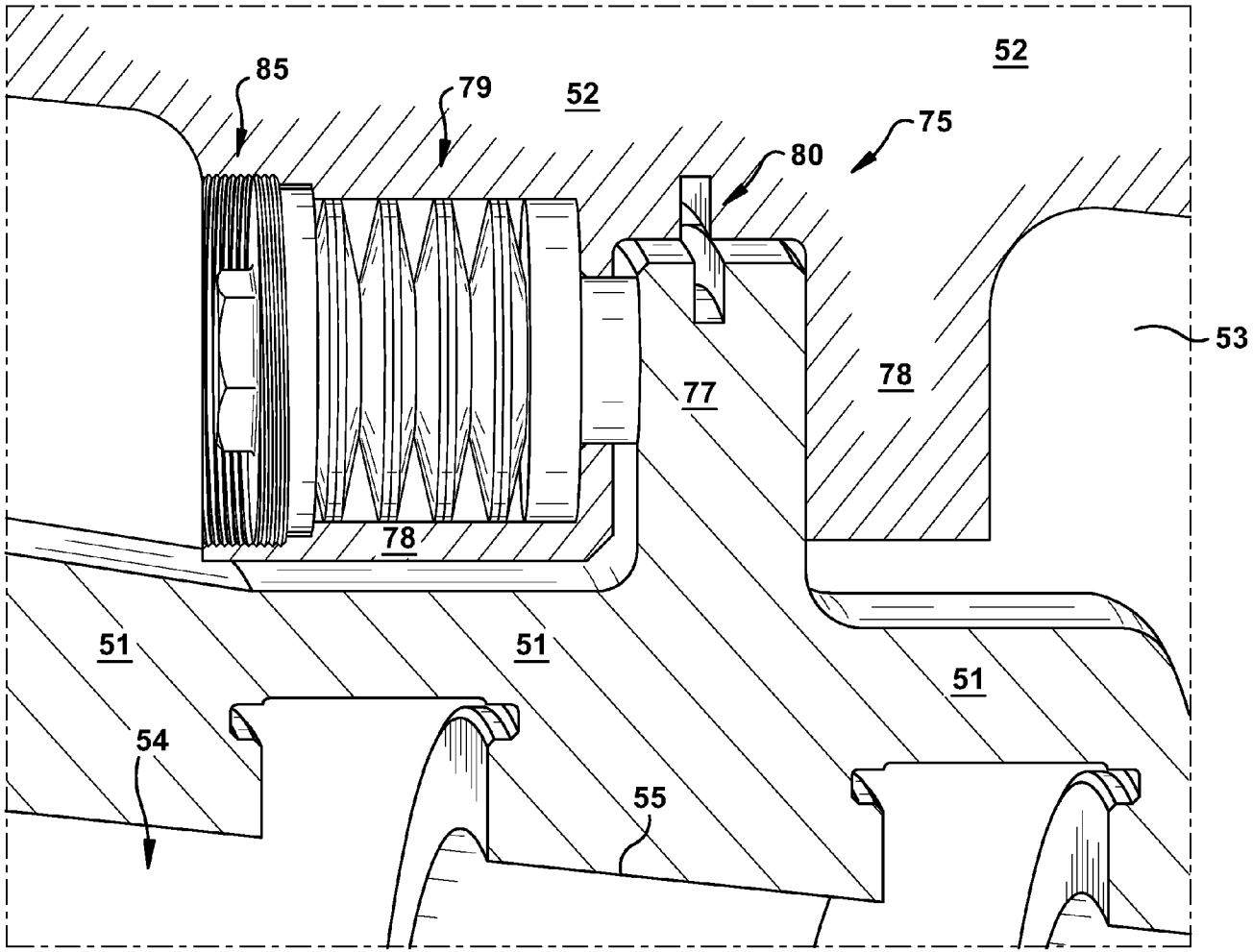
FIG. 6 is a schematic sectional representation of a connection assembly between an inner casing and outer casing according to certain aspects of the present invention.
Figure 7:
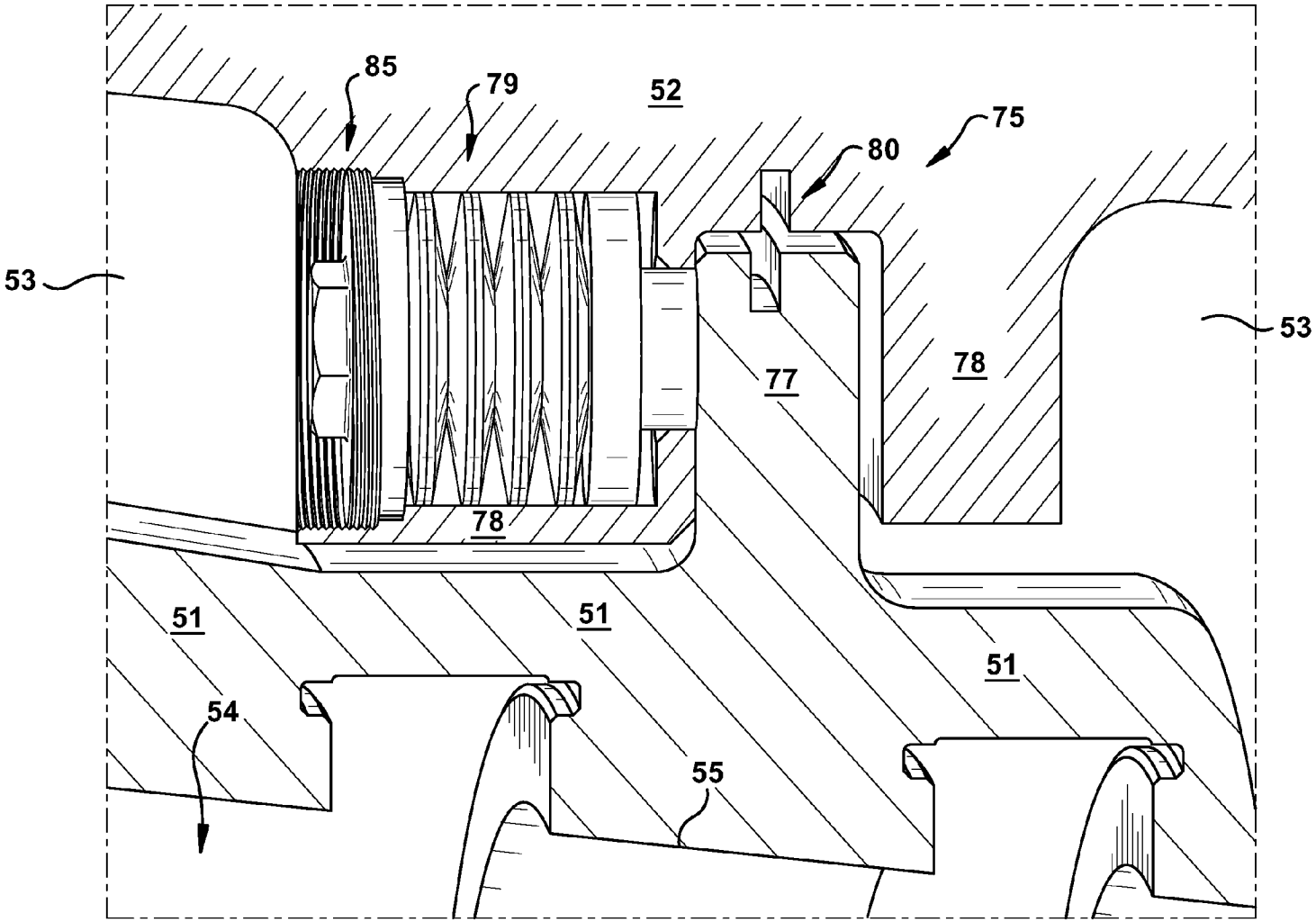
FIG. 7 is a schematic sectional representation of a connection assembly between an inner casing and outer casing according to other aspects of the present invention.

Turning now to FIGS. 5 through 7, there is illustrated exemplary embodiments of a mechanical apparatus by which the axial positioning of an inner casing 51 may be passively controlled based upon pressure differentials occurring within the flowpath 54 during different modes of engine operation. As part of the present invention, the mechanical control apparatus as well as the novel methods and procedures related thereto may be used to efficiently control the positioning of the inner casing 51 so to narrow leakage pathways typically present between rotating and stationary structure within in the turbine engine 10. It will be appreciated that the present invention may be used in either the compressor 11 or the turbine 13 sections of the engine 10. Pursuant to some of the particular embodiments described below, the axial arrangement of certain components may be described relative to the direction in which the flowpath converges and diverges, which, it will be appreciated, may be designated in relation to a conically shaped flowpath 54 (i.e., a flowpath having a boundary profile that is axially canted or tilted).

FIG. 5 provides a simplified schematic sectional representation of an exemplary flowpath 54 as might be found in either a compressor 11 or turbine 13 of a gas turbine engine 10, and is provided to illustrate certain aspects of the present invention. As in FIG. 4, an outer casing 52 may be concentrically arranged about an inner casing 51 so that an annulus 53 is formed therebetween. The inner casing 51 may define an outboard boundary 55 of the flowpath 54. As illustrated, the outboard boundary 55 may be axially tilted relative to the longitudinal axis of the engine. Relative to the orientation of the axial tilt, as stated above, it will be appreciated that a converging direction 72, in which the flowpath 54 converges, and a diverging direction 71, in which the flowpath 54 diverges, may be designated. It will further be appreciated that, if the flowpath 54 were the flowpath of a compressor 11, the converging direction 72 would coincide with a downstream direction, and the diverging direction 71 would coincide with an upstream direction. Additionally, the converging direction 72 is the direction in which pressure increases during operation of the engine 10. On the other hand, if the flowpath 54 is defined in a turbine 13, the converging direction 72 would coincides with an upstream direction, and the diverging direction 71 would coincides with a downstream direction. The converging direction 72 remains the direction in which pressure increases. For the sake of clarity, further discussion of FIG. 5 will discuss the flowpath 54 as if it is part of a compressor 11, though it will be appreciated that the principles also are applicable to a turbine 13, particularly if axial position is provided in terms of a converging or diverging direction because, in either case, whether in a compressor 11 for a turbine 13, pressure along the flowpath 54 increases in the converging direction. As discussed in more detail below, the inboard boundary 55 also may include an axially tilted configuration.

FIG. 5 illustrates a row of rotor blades 61 positioned upstream of a row of stator blades 62. The rotor blades 61 may have outer tips 41 that oppose the outboard boundary 55 across a gap clearance 65 that is defined therebetween. The stator blades 62 may have inner tips 42 that oppose the inboard boundary 55 across a gap clearance 67 defined therebetween.

As illustrated, the connection assembly 75 may be configured to slidably connect the inner casing 51 to the outer casing 52 for axial movement. As part of the connection assembly 75 a biasing structure, such as a spring 79, may be used for axially preloading the inner casing 51 in the converging direction 72. In a preferred embodiment, the biasing structure may include a Belleville washer or compression spring 79 (which also may be known as a disk spring). In other embodiments, other biasing means may be used, such as leaf springs or metal foam or other type of spring or system that includes magnetic biasing.

The annulus 53 may include an extraction passage 66 that fluidly communicates with an extraction point in the flowpath 54. In this manner, a pressure in the annulus 53 may be achieved that directly relates or is proportional to a pressure in the flowpath 54. As illustrated, in a preferred embodiment, the connection assembly 75 is configured to divide the annulus 53 into a first or downstream annulus 57, which in this case corresponds to the converging direction 72, and a second or upstream annulus 58, which in this case corresponds to the diverging direction 71. The connection assembly 75 may include a seal 80 that is configured to fluidly seal the downstream annulus 57 from the upstream annulus 58 so to maintain a pressure differential therebetween. The seal 80 may be any conventional type of seal that achieves the purpose and functionality described herein. It will be appreciated that the seal 80 may be incorporated into the connection assembly 75, as illustrated, or it may be a separate component.

The downstream annulus 57 may include an extraction passage 66 that fluidly communicates with a first extraction point on the flowpath 54. In this manner a pressure may be created in the downstream annulus 57 that directly relates to or is proportional to a pressure at a particular location in the flowpath 54. The upstream annulus 58 may include an extraction passage 66 that fluidly communicates with a second extraction point on the flowpath 54. In this manner, a pressure may be created in the upstream annulus 58 that directly relates to or is proportional to a pressure at a second particular location on the flowpath 54. As illustrated, the two extraction locations may be axially spaced along the flowpath 54. In a preferred embodiment, the extraction points are positioned to each side of the row of rotor blades 61. It will be appreciated that the wide axially spacing of the extraction points may be used to purposefully create materially different levels of pressure within each of the upstream annulus 58 and the downstream annulus 57, as pressure differentials between two points on the flowpath 54 generally increase as the distance between the increases. It will be appreciated that, within a combustor 11, the downstream annulus 57 will have a higher pressure than that of the upstream annulus 58 given that its extraction point is further downstream.

The inner casing 51 includes an outboard surface that defines a boundary of the annulus 53. As illustrated, the inner casing 51 may be configured such that it includes a surface area or receiving surface exposed to both the downstream annulus 57 and the upstream annulus 58. Configured in this way, it will be appreciated that the surface of the inner casing 51 receives the pressure within each annulus 57, 58, and that this results in the application of a force to the inner casing 51 that is proportional to the level of this pressure in each annulus 57, 58. Given the orientation of some of the surface areas of the inner casing, it will be appreciated that this force or load includes an axially directed component. The axially directed component of this resulting load may be referred to herein as a "pressure load". It will be further appreciated that each of the upstream annulus 58 and the downstream annulus 57 loads the inner casing 51 in this manner so to create axial pressure loads that oppose each other. Because the pressure in the downstream annulus 57 is greater than that of the upstream annulus 58, the system of the present invention is configured so that a net force or pressure load is applied to the inner casing in the diverging direction 71. Furthermore, the system of the present invention may be configured such that this resulting pressure load is a dynamic one, which is based upon or proportional to an amount by which the pressure in the downstream annulus 57 exceeds the pressure in the upstream annulus 58. Because the pressure in each annulus 57, 58 directly relates to a pressure at a specific region on the flowpath 54, it will be appreciated that the resulting axial pressure load on the inner casing 51 may be configured to directly relate or be proportional to a pressure differential between specific locations of the flowpath 54 (i.e., the pressure differential between the two extraction points). Accordingly, the arrangement of the present invention enables engine operators to take advantage of passive controls that react to certain pressure load levels on the inner casing 51 because such load levels reflect pressure differentials in the flowpath 54, which, in turn, reflect certain modes of engine operation.

In one preferred embodiment, the outboard boundary 55 of the flowpath includes a configuration in which axial movement of the inner casing 51 results in a narrowing of a leakage path. In this instance, the system may be configured such that the mode of engine operation that produces a predetermined threshold pressure load that initiates axial movement of the inner casing is also a mode of operation in which the leakage path is wide. As illustrated, pursuant to aspects of the present invention, a sloping or axially tilted outboard boundary 55 is a flowpath configuration that may be used to narrow a leakage path (such as the gap clearance 65) by axially moving the inner casing 51 in the diverging or upstream direction. Further aspects of this axial tilt are discussed in more detail below.

As shown, in one preferred embodiment, the connection assembly 75 includes a radially interlocking structure in which an inner casing flange 77, which also may be referred to as an axial thrust collar, engages a slot formed between two outer casing flanges 78, though it will be appreciated that other configurations are possible. As illustrated, the width of the slot may be oversized relative to the axial width of the inner casing flange 77. In this manner, the opposing sidewalls of the slot define limits or a range for the axial movement of the inner casing 51. The opposing sidewalls of the slot provide mechanical stops beyond which axial movement of the inner casing is prevented. The axial range of movement may depend upon several factors including the type of turbine engine, flowpath architecture, and operating conditions. According to a particular preferred embodiment, the axial range of the axial movement of the inner casing 51 is between 0.15 and 0.35 inches. In certain embodiments, the connection assembly 75 includes a compression spring 79 that is used to bias the inner casing 51 toward an initial position. In this case, the compression spring 79 forces the flange 77 toward the converging or downstream sidewall of the slot. As illustrated, in a preferred embodiment, the compression spring 79 has a first end that engages the flange 77 and a second end that engages the diverging or upstream sidewall of the slot.

FIGS. 6 and 7 provide close-up views of the connection assembly 75. It will be appreciated that in FIG. 6 the inner casing 51 resides in an initial position, which is the position in which the flange 77 rests against a downstream stop (in this case, an outer casing flange 78). In FIG. 7, the inner casing 51 is forced in the upstream or diverging direction by a pressure load that is larger than the force applied by the compression spring 79. In this position, the compression spring 79 is compressed between the inner casing flange 77 and the outer casing flange 78 and, pursuant to certain embodiments, is prevented from further movement in that direction by a mechanical stop that is part of the outer casing flange 78.

As further illustrated, the outer casing upstream flange 78 and the compression spring 79 may include a threaded connection 85, which allows for the adjustment of the preload compression of the spring 79. In this manner, the static load of the compression spring may be very such that the axial movement of the inner casing 51 occurs at a particular operating mode, i.e., the operating mode that provides a pressure differential in the flowpath 54 that overcomes the preloading of the spring 79 to initiate axial movement of the inner casing 51. More specifically, the axial preload of the compression spring 79 may be configured at a threshold such that: a) during a first mode of engine operation, the axial preload exceeds the axial pressure loading of the inner casing 51 receiving surface so that the inner casing 51 remains in an initial position; and b) during a second mode of engine operation, the axial pressure loading of the inner casing 51 receiving surface exceeds the axial preload such that axial movement to a second position is initiated. As illustrated, the threaded connection 85 is configured such that an upstream end of the compression spring 79 is threadably received by the upstream outer casing flange 78 such that rotational adjustment axially displaces that end of the compression spring 79.

A row of stator blades 62 is positioned just downstream of the rotor blades 61 and attached to the inner casing 51. The stator blades 62 having inner tips 42 that oppose rotating structure that defines the inboard boundary 55 of the flowpath 54. An inner gap clearance 65 is defined between the inner tips 42 of the stator blades 62 and the inboard boundary 55 of the flowpath 54. In certain embodiments, the inboard boundary 55 of the flowpath 54 comprises an axial tilt. In preferred embodiments, the axial tilt of the inboard boundary 55 converges the flowpath 54 in the same direction as the axially tilted outboard boundary 65. It will be appreciated that, given the axial tilt of the outboard boundary 55, the gap clearance 65 between the rotor blades 61 and the inner casing 51 narrows as the inner casing 51 moves in the diverging direction, which, as stated, occurs when the biasing preload is overcome. As illustrated in FIG. 5, given the arrangement of the gap clearance 67 and the inboard flowpath boundary 56 (which is a typical one in many conventional turbine engines), the same axial movement of the inner casing 54 would result in widening the inner gap clearance 67. It will be appreciated, however, that having a steeper tilt along the outboard boundary 55 than along the inboard boundary 56 results in a net closure of leakage pathways. For example, the axial tilt angle 64 of the outboard boundary 55 may be between 5° and 35°; and the axial tilt angle of the inboard boundary 56 is between 0° and 25°. Other configurations are also possible. To enhance leakage path closure, the outer tips 41 of the rotor blades 61 may include an axial tilt that is substantially the same as the axial tilt of the outboard boundary 55 so that, between a forward edge and an aft edge of the outer tips 41, a substantially constant offset from the outboard boundary 55 is maintained therebetween. The same configuration may also be present between the inner tips 42 and the inboard boundary 56.

The present invention further describes methods and processes by which the mechanical systems described above may be employed. Pursuant to one exemplary embodiment, the present invention includes a method of passively varying an axial position of the inner casing 51 in a compressor 11 between an upstream location and a downstream location based upon modes of engine operation. The method may include the steps of: slidably connecting the inner casing 51 to the outer casing 52 for axial movement between a downstream position and an upstream position; forming a high-pressure region and a low pressure region in the annulus 53 by extracting working fluid from axially spaced pressure regions in the flowpath 54; configuring the inner casing 51 with opposing receiving surfaces, a first receiving surface disposed in the high-pressure region and a second receiving surface disposed in the low-pressure region of the annulus 53, for axially loading the inner casing 51 toward the upstream position relative to an amount by which a pressure in the high-pressure region exceeds a pressure in the low-pressure region of the annulus 53. The method may further include the step of configuring the outboard boundary 55 and an inboard boundary 55 of the flowpath 54 such that leakage paths between stationary and rotating structures are wider when the inner casing 51 occupies the first axial position and narrower when the inner casing 51 occupies the second axial position.

An alternative embodiment describes a method for passively controlling an axial position of an inner casing 51 of a compressor or a turbine. In this instance, the inner casing 51 defines an axially tilted outboard boundary 55 that, relative thereto, defines a converging direction in which the flowpath 54 converges and a diverging direction in which the flowpath 54 diverges. This embodiment may include the steps of: slidably connecting the inner casing 51 to the outer casing 52 for axial movement between a first axial position in the converging direction and a second axial position in the diverging direction; using a static load derived from a mechanical biasing means to axially preload the inner casing 51 toward the first axial position; extracting working fluid from a high-pressure extraction point and a low-pressure extraction point from the flowpath 54; and in the annulus 53, axially loading opposing receiving surfaces on the inner casing 51 with a pressure derived from the extracted working fluid so to oppose the mechanical biasing means with a dynamic pressure load, the dynamic pressure load configured to directly relate to a current pressure differential between the high-pressure extraction point and the low-pressure extraction point. As described above, the opposing receiving surfaces may include a first receiving surface and a second receiving surface, and the dynamic pressure load may be derived by axially loading the first receiving surface toward the diverging direction with a pressure derived from the working fluid extracted from the high-pressure extraction point, and axially loading the second receiving surface toward the converging direction with a pressure derived from the working fluid extracted from the low-pressure extraction point. The method may further include the steps of determining a first mode of engine operation in which the inner casing 51 is preferably located in the first axial position based on a leakage path clearance defined between opposing rotating and stationary structure, as well as determining a second mode of engine operation in which the inner casing 51 is preferably located in the second axial position based upon the leakage path clearance. Once this is complete, an engine operator and/or component designer may then determining an amount by which the dynamic pressure load of the second mode of engine operation exceeds the dynamic pressure load of the first mode of engine operation. This pressure load differential between operating modes then may be used to tune tuning the amount by which the mechanical biasing means axially preloads the inner casing 51 toward the first axial position. Specifically, the axial preload may be based upon the amount by which the dynamic pressure load of the second mode of engine operation exceeds the dynamic pressure load of the first mode of engine operation. The static preload may be set so that it is greater than the dynamic pressure load during the first mode of engine operation; and less than the dynamic pressure load during the second mode of engine operation.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A gas turbine engine comprising:

a flowpath defined through one of a compressor and a turbine;

an inner casing defining an axially tilted outboard boundary of the flowpath, which, relative to the axial tilt, defines a converging direction in which the flowpath converges and a diverging direction in which the flowpath diverges;

a row of rotor blades having outer tips that oppose the outboard boundary across a gap clearance defined therebetween;

an outer casing concentrically arranged about the inner casing so to form an annulus therebetween; and a connection assembly that slidably connects the inner casing to the outer casing for axial movement;

wherein the connection assembly includes mechanical biasing means for axially preloading the inner casing in the converging direction; the mechanical biasing means comprising a compression spring;

wherein the annulus comprises at least one extraction passage that fluidly communicates with at least one extraction point, respectively, in the flowpath for producing a pressure in the annulus proportional to a pressure at the extraction point; and wherein the inner casing includes at least one receiving surface configured to receive the pressure in the annulus for producing a net axial loading on the inner casing in the diverging direction.

2. The gas turbine engine according to claim 1, wherein the axial preload of the compression spring comprises a threshold load configured such that: a) during a first mode of engine operation, the axial preload exceeds the axial loading of the at lease one receiving surface such that axial movement of the inner casing in the diverging direction is prevented; and b) during a second mode of engine operation, the axial loading of the at lease one receiving surface exceeds the axial preload such that axial movement in the diverging direction is initiated.

3. The gas turbine engine according to claim 1, wherein the connection assembly axially divides the annulus into a first annulus and a second annulus and wherein the connection assembly includes a seal configured to fluidly seal the first annulus from the second annulus so to maintain a pressure differential therebetween;

wherein the first annulus comprises a first extraction passage of the at least one extraction passage that fluidly communicates with a first extraction point of the at least one extraction point on the flowpath for producing a pressure in the first annulus proportional to a pressure at the first extraction point, and the second annulus comprises a second extraction passage of the at least one extraction passage that fluidly communicates with a second extraction point of the at least one extraction point on the flowpath for producing a pressure in the second annulus proportional to a pressure at the second extraction point; and wherein the first extraction point is axially spaced from the second extraction point such that the first extraction point is disposed in the converging direction relative to the row of rotor blades, and the second extraction point is disposed in the diverging direction relative to the row of rotor blades.

4. The gas turbine engine according to claim 3, wherein the inner casing comprises a first receiving surface of the at least one receiving surface disposed in the first annulus and a second receiving surface of the at least one receiving surface in the second annulus, each of the first and second receiving surfaces configured, respectively, to receive the pressure in the first annulus and the pressure in the second annulus for axially loading the inner casing.

5. The gas turbine engine according to claim 3, wherein the inner casing comprises a first receiving surface of the at least one receiving surface configured to receive a pressure of the first annulus for axially loading the inner casing in the diverging direction; and wherein the inner casing comprises a second receiving surface of the at least one receiving surface configured to receive a pressure of the second annulus for axially loading the inner casing in the converging direction.

6. The gas turbine engine according to claim 3, wherein the inner casing includes two opposing receiving surfaces of the at least one receiving surface, one exposed to the first annulus and the other exposed to the second annulus, wherein the two opposing receiving surfaces are configured to produce the net axial loading on the inner casing in the diverging direction in response to an amount by which the pressure in the first annulus exceeds the pressure in the second annulus.

7. The gas turbine engine according to claim 6, wherein the compression spring comprises a Belleville washer.

8. The gas turbine engine according to claim 1, wherein the connection assembly comprises a radially interlocking structure in which a flange extending from one of the inner casing and the outer casing engages a slot formed in the other one of the inner casing and the outer casing; and wherein an axial width of the slot is oversized relative to an axial width of the flange such that opposing sidewalls of the slot define limits for the axial movement of the inner casing.

9. The gas turbine engine according to claim 8, wherein the slot is formed in the outer casing and the flange extends from the inner casing;

wherein, designated relative to the converging and the diverging directions of the flowpath, the opposing sidewalls of the slot have a converging sidewall, which includes a mechanical stop defining a first axial limit, and a diverging sidewall, which includes a mechanical stop defining a second axial limit; and wherein the mechanical biasing means comprises the compression spring that biases the flange toward the converging sidewall of the slot, the compression spring including a first end that engages the flange and a second end that engages the diverging sidewall of the slot.

10. The gas turbine engine according to claim 9, wherein the connection assembly comprises means for adjusting a preload compression of the compression spring; and wherein the means for adjusting the preload compression of the compression spring comprises a threaded connection between at least one of: the first end of the compression spring and the flange;

and the second end of the compression spring and the diverging sidewall of the slot.

11. The gas turbine engine according to claim 10, wherein the threaded connection is disposed between the second end of the compression spring and the diverging sidewall of the slot, and wherein, upon adjustment, the threaded connection is operably configured to axially displace the second end of the compression spring; and wherein the first axial limit and the second axial limit of the axial movement of the inner casing is between 0.15 and 0.35 inches.

12. The gas turbine engine according to claim 1, wherein the flowpath is defined through the compressor so that, relative to a direction of flow through the flowpath, the diverging direction comprises an upstream direction and the converging direction comprises a downstream direction.

13. The gas turbine engine according to claim 1, wherein the flowpath is defined through the turbine so that, relative to a direction of flow through the flowpath, the diverging direction comprises a downstream direction and the converging direction comprises an upstream direction.

14. The gas turbine engine according to claim 1, further comprising a row of stator blades attached to the inner casing, the stator blades having inner tips that oppose a rotating structure defining an inboard boundary of the flowpath;

wherein an inner gap clearance is defined between the inner tips of the stator blades and the inboard boundary; and wherein the inboard boundary of the flowpath comprises an axial tilt.

15. The gas turbine engine according to claim 14, wherein the axial tilt of the inboard boundary comprises the same converging direction and diverging direction as the axial tilt of the outboard boundary;

wherein the axial tilt of the outboard boundary is steeper than the axial tilt of the inboard boundary.

16. The gas turbine engine according to claim 15, wherein the axial tilt of both the outboard boundary and the inboard boundary define a tilt angle relative to an axial reference line;

wherein the tilt angle of the outboard boundary is between 5° and 35°; and wherein the tilt angle of the inboard boundary is between 0° and 25°.

17. The gas turbine engine according to claim 1, wherein the outer tips of the rotor blades comprise an axial tilt that is substantially the same as the axial tilt of the outboard boundary so that, between a forward edge and an aft edge of the outer tips, a substantially constant offset from the outboard boundary is maintained therebetween.

18. A gas turbine engine comprising:

a compressor through which a flowpath is defined, the flowpath having a downstream and an upstream direction relative to a flow of working fluid therethrough;

an inner casing defining an outboard boundary of the flowpath having an axially tilted profile so that, along the outboard boundary, the flowpath has a conical taper in the downstream direction;

a row of circumferentially spaced rotor blades positioned in the flowpath, the rotor blades having outer tips that oppose the outboard boundary across a gap clearance defined therebetween;

an outer casing concentrically arranged about the inner casing so to form an annulus therebetween; and a connection assembly that slidably connects the inner casing to the outer casing for axial movement between a downstream position and an upstream position;

wherein the connection assembly includes a compression spring that axially preloads the inner casing toward the downstream position;

wherein the inner casing includes at lease one receiving surface that defines a boundary of the annulus, the at lease one receiving surface configured to produce a net axial load on the inner casing toward the upstream position so to oppose the axial preload of the compression spring;

wherein the connection assembly axially divides the annulus into an axially stacked downstream annulus and an upstream annulus, and wherein the connection assembly includes a seal configured to fluidly seal the downstream annulus from the upstream annulus so to maintain a pressure differential therebetween; and wherein the downstream annulus comprises an extraction passage that fluidly communicates with a downstream extraction point for producing a pressure therein that is proportional to a pressure at the downstream extraction point, and the upstream annulus comprises an extraction passage that fluidly communicates with an upstream extraction point in the flowpath for producing a pressure therein that is proportional to a pressure at the upstream extraction point.

19. The gas turbine engine according to claim 18, wherein the downstream extraction point is disposed downstream relative to the row of rotor blades, and the upstream extraction point is disposed in the upstream direction relative to the row of rotor blades;

wherein the inner casing includes a first receiving surface of the at least one receiving surface disposed in the downstream annulus and a second receiving surface of the at least one receiving surface in the upstream annulus, each of the first and second receiving surfaces configured, respectively, to receive the pressure in the downstream annulus and the upstream annulus for axially loading the inner casing;

wherein the first receiving surface and the second receiving surface are configured to produce the net axial load on the inner casing in the upstream direction in response to an amount by which the pressure in the downstream annulus exceeds the pressure in the upstream annulus; and wherein the compression spring comprises a Belleville washer that includes a threaded connection to one of the inner casing and the outer casing for tuning the axial preload.

* * * * *